US012628991B2

(12) United States Patent
Hildersley et al.

(10) Patent No.: US 12,628,991 B2
(45) Date of Patent: May 19, 2026

(54) TABLETOP FOLDED SHEET DISPENSER

(71) Applicant: Essity Hygiene and Health Aktiebolag, Gothenburg (SE)

(72) Inventors: Catherine Mary Hildersley, Boston, MA (US); Evan Alton Hutker, Boston, MA (US); John P. Devlin, Boston, MA (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 198 days.

(21) Appl. No.: 17/802,459

(22) PCT Filed: Jul. 19, 2021

(86) PCT No.: PCT/EP2021/070126
§ 371 (c)(1),
(2) Date: Aug. 25, 2022

(87) PCT Pub. No.: WO2023/001357
PCT Pub. Date: Jan. 26, 2023

(65) Prior Publication Data
US 2024/0148198 A1 May 9, 2024

(51) Int. Cl.
*A47K 10/42* (2006.01)
*A47K 10/32* (2006.01)

(52) U.S. Cl.
CPC .... *A47K 10/422* (2013.01); *A47K 2010/3233* (2013.01); *A47K 2010/3246* (2013.01)

(58) Field of Classification Search
CPC ..... A47K 10/422; A47K 10/427; A47K 2010/3233; A47K 2010/3246
See application file for complete search history.

(56) References Cited

U.S. PATENT DOCUMENTS 6,331,696 B1 12/2001 Nakamura et al.
7,527,170 B2 * 5/2009 Slocum ..... B60R 11/00 221/45

(Continued)

FOREIGN PATENT DOCUMENTS

CN 1293940 A 5/2001
CN 102711572 A 10/2012
NC 20200003127 4/2020

OTHER PUBLICATIONS

International Search Report & Written Opinion for International Application No. PCT/EP2021/070126; International Filing Date: Jul. 19, 2021; Date of Mailing: Mar. 18, 2022; 10 pages.

(Continued)

*Primary Examiner* — Gene O Crawford
*Assistant Examiner* — Kelvin L Randall, Jr.
(74) *Attorney, Agent, or Firm* — CANTOR COLBURN LLP

(57) ABSTRACT

Disclosed is a dispenser for dispensing sheet material, the dispenser including a moveable platform and a releasable locking mechanism for holding the platform, the releasable locking mechanism including a first arm movably attached to one of the side walls, wherein the first arm has a top end and a base end, a second arm movably attached to the base, wherein the second arm has a side wall end and a locking end, the side wall end cooperating with the base end of the first arm to cause movement of the second arm, the locking end releasably interlocking with a locking portion arranged at the platform to hold the platform in the locking position, wherein the lid has an engaging portion at its lower surface engageable with the top end of the first arm upon closing the lid to release the platform from a locking position.

20 Claims, 6 Drawing Sheets

(56) References Cited

U.S. PATENT DOCUMENTS

| | | | | |
|---|---|---|---|---|
| 10,980,377 | B1 * | 4/2021 | Falk | A47K 10/422 |
| 11,641,986 | B2 * | 5/2023 | Bing | A47K 10/422 221/52 |
| 2002/0030045 | A1 * | 3/2002 | Nakamura | A47K 10/422 219/521 |
| 2006/0027593 | A1 | 2/2006 | Slocum | |
| 2007/0138263 | A1 * | 6/2007 | Tocher | G07D 11/13 235/381 |
| 2012/0305586 | A1 | 12/2012 | Taylor | |
| 2014/0319164 | A1 | 10/2014 | Wilson et al. | |
| 2018/0116473 | A1 * | 5/2018 | Chalko | A47K 10/422 |
| 2020/0024073 | A1 * | 1/2020 | Ferrara | B65F 1/1615 |
| 2020/0196810 | A1 | 6/2020 | Dallaire | |
| 2021/0007561 | A1 * | 1/2021 | McNulty | A47K 10/422 |
| 2021/0186273 | A1 | 6/2021 | Kunda et al. | |
| 2021/0204765 | A1 * | 7/2021 | Falk | A47K 10/422 |
| 2022/0167803 | A1 * | 6/2022 | Bing | A47K 10/422 |

OTHER PUBLICATIONS

Colombian Application No. NC2024/0000144; Office Action with English dated Sep. 17, 2024; 23 pages.
CN Office Action with English Translation; CN App 202180100770.1; Date Mailed: Sep. 26, 2025; pp. 1-17.

* cited by examiner

TABLETOP FOLDED SHEET DISPENSER

CROSS REFERENCE TO RELATED APPLICATIONS

This application is a National Stage application of PCT/EP2021/070126, filed Jul. 19, 2021, which is incorporated by reference in its entirety herein.

TECHNICAL FIELD

The present disclosure relates to a dispenser for dispensing sheet material, particularly sanitary paper sheet material such as hand towels, paper napkins, facials, or other wiping material in sheet form. More particularly, the present disclosure relates to a tabletop folded sheet dispenser.

BACKGROUND

Sheet material is generally stacked and accommodated in a dispenser. The individual sheet material may be folded. Continuous dispensing of the folded sheet material from the dispenser is enabled by interfolding consecutive sheet material.

The sheet material may be napkins. In this context, interfolded napkins may be used. Interfolded napkins are sheets of materials arranged in a stack of superposed sheets, which are each folded at least once. The sheets are interlinked in such a way that the separate folded sheets of material form a chain of sheets in which each sheet has a leading panel and a trailing panel, the trailing panel being at least partly overlapped with the leading panel of the subsequent sheet in the stack. In this manner, the individual sheets are held loosely together by means of frictional forces arising between the overlapping parts. The sheets may be dispensed from a dispenser by pulling at the leading panel of the first sheet (leading sheet) in the stack. In this manner, the first sheet is extracted at the same time as a predetermined part of the leading panel of a subsequent sheet is fed into a dispensing position in the dispenser.

In many conventional dispenser types, a stack of sheet material accommodated in the dispenser is urged in a direction towards the dispensing opening. One type of such dispensers is a tabletop dispenser. A tabletop dispenser may be placed on top of a table, such as a table in a restaurant, and individual sheet material, such as a napkin, is withdrawn from the stack of sheet material from the top of the dispenser. In a tabletop dispenser, the stack of sheet material is usually supported by a movable platform from below, wherein the platform is urged upwards towards the dispensing opening by means of a spring or the like disposed below the platform.

In order to load an empty tabletop dispenser having such platform, the user removes or opens the lid of the dispenser in which the dispensing opening is provided, places the stack of sheet material on the platform and pushes down the stack (together with the platform) into the dispenser, whereby the user has to overcome the force exerted by the spring. In order to enable easy closing of the lid and avoid the spring ejecting the stack of sheet material, the platform is held in the lower position in the dispenser by means of a locking mechanism provided in the dispenser. The locking mechanism is releasable such that the stack of sheet material is urged towards the dispensing opening again once the lid is closed.

One problem with dispensers of this kind is that the platform is not always held in a horizontal orientation by the locking mechanism, parallel to the tabletop, but rather in a tilted position. Thus, the stack of sheet material is tilted to one side instead of having an upright orientation. In this case, when the locking mechanism is released, the stack of sheet material is not urged upwards towards the dispensing opening in an upright direction but rather in a tilted direction. Not only does this lead to the leading sheet material not being easily graspable anymore from the dispensing opening but also to an uneven force distribution across the stack of sheet material, thereby making it difficult to withdraw an individual sheet of material.

Hence, there is a need to improve the locking mechanism. This is, however, challenging because the locking mechanism is designed in a way not to interfere with the sheet material, while, at the same time, the space available for the sheet material should not be reduced and the overall size of the dispenser should not be increased excessively.

SUMMARY

Therefore, it is an object of the present disclosure to provide a dispenser, in particular a tabletop dispenser, enabling easy withdrawal of individual sheet material, while maintaining the space available for the sheet material.

The above-described problem is solved by the dispenser according to claim 1. Preferred embodiments are set out in the dependent claims.

According to one aspect, a dispenser for dispensing sheet material comprises a body having four side walls, a base, e.g. for resting on a support surface, an opening in a top of the body, a lid for covering the opening in use and enabling access to the opening for refilling, wherein the lid may be detachable for giving access to the opening, or, alternatively, wherein the lid may be movably attached to at least one of the side walls and may be sized to cover the opening, wherein the lid has a dispensing opening therein to enable sheet material to be dispensed therefrom, a platform for supporting a plurality of sheet material from below, wherein the platform is movable from a lowermost position when the dispenser is filled with sheet material to an uppermost position adjacent the lid when the dispenser is more nearly empty of sheet material, a biasing means for urging the platform towards the lid, a releasable locking mechanism for holding the platform in a locking position in the lowermost position. The releasable locking mechanism comprises a first arm movably attached to one of the side walls and extending in a direction from the top towards the base of the body, wherein the first arm has a top end and a base end, a second arm movably attached to the base and extending in a direction from the side wall to which the first arm is attached towards a center of the base, wherein the second arm has a side wall end and a locking end, the side wall end being configured to cooperate with the base end of the first arm such that a movement of the first arm causes a movement of the second arm, the locking end being configured to releasably interlock with a locking portion arranged at the platform to thereby hold the platform in the locking position, wherein the lid has an engaging portion at its lower surface configured to engage with the top end of the first arm upon closing the lid to thereby release the platform from the locking position.

Since the releasable locking mechanism comprises a first arm movably attached to one of the side walls and extending in a direction from the top towards the base of the body and a second arm movably attached to the base and extending in a direction from the side wall to which the first arm is attached towards a center of the base, the locking mechanism extends along wall and base parts of the dispenser, thereby not occupying space of the interior of the dispenser intended for the sheet material. As a result, the space in the dispenser available for the stack of sheet material can be maintained. Moreover, since the second arm extends towards the center of the base, where its locking end interlocks with the locking portion arranged at the platform, a locking connection between the second arm and the platform is established in a central area of the platform, thereby holding the platform in the locking position in a horizontal orientation. In this context, "horizontal orientation" may mean that the platform is oriented in parallel with the base of the dispenser. If the dispenser is placed on a tabletop, "horizontal orientation" may also imply that the platform is oriented in parallel with the tabletop. As a consequence, upon releasing the locking mechanism, the platform with the stack of sheet material placed thereon is urged towards the dispensing opening in an upright orientation, i.e. the stack of sheet material is urged towards the dispensing opening in a substantial vertical direction with respect to the base (and the tabletop). Hence, this configuration enables easy withdrawal of individual sheet material from the dispenser.

In contrast, in state-of-the-art-dispensers, the platform is held in the locking position at one edge thereof by the locking mechanism. Since the biasing means for urging the platform towards the lid is usually arranged in a central area of the platform, this leads to a tilted orientation of the platform in the locking position. Thus, the stack of sheet material is not urged towards the dispensing opening in an upright orientation, but in a tilted orientation, thereby leading to the above-described problems.

The lid may be movably attached to at least one of the side walls by means of one or more hinges or the like. It is also conceivable, that the lid is attached to two of the side walls. Accordingly, the lid may be permanently attached to the body of the dispenser and may be tilted from an open refilling position to a closed use position. Such an arrangement ensures an easy and reliable closing and opening of the lid with respect to the body of the dispenser.

Alternatively, the lid may be configured to be reversibly removable and attachable to the body. In other words, the lid may be temporarily removable from the body of the dispenser and be re-attached thereto. This may allow for easier refilling of the dispenser, as the lid can temporarily be put aside.

The dispensing opening in the lid may be formed as a slot, as known from prior art dispensers.

The dispensing opening in the lid may open to the top of the dispenser and the dispenser rests on the support surface via the base thereof. Accordingly, the sheet material may be dispensed along a vertical direction when the dispenser rests on a support surface via the base.

Yet, it may also be possible to arrange the described tabletop dispenser in an upright/flipped position, that is, in a position, in which the base extends in a vertical direction and the dispenser rests on one of the four side walls. Accordingly, also the lid, which opposes the base of the dispenser, may extend along the vertical direction, such that sheet material may be dispensed along a horizontal direction via the lid.

Thus, the base and/or at least one of the side walls may comprise an anti-slip protection to ensure a fixed position of the dispenser when resting on the base or on one of the side walls.

The lowermost position of the platform may be defined as the position of the platform in which the platform is held, via the locking end of the second arm being interlocked with the locking portion of the platform, in the locking position. Since the biasing means urges the stack of sheet material towards the dispensing opening, the stack of sheet material may come into contact with the inner surface of the lid. Upon withdrawing the sheet material, the stack of sheet material is reduced in height such that the platform is moved upwards. Once the stack of sheet material only comprises very little sheet material, for example, one to five individual sheets, the platform may be in the uppermost position adjacent the lid, in which an upper surface of the platform for supporting the stack of sheet material may be disposed close to an upper end of the side walls, i.e. in substantially the same height.

The biasing means for urging the platform towards the lid may be a spring, in particular a coil spring.

The first arm may have a flat shape so as not to protrude towards the interior of the dispenser in order not to interfere with the stack of sheet material and/or the platform. The first arm may be movable translationally and/or rotationally with respect to the side wall to which the first arm is attached. The first arm may extend along the whole length of the side wall from the top towards the base of the body or along a substantial portion of the length of the side wall from the top towards the base of the body. The first arm may be provided at either one of the four side walls. The top end is the end of the arm located closer to the opening of the body than the other end of the first arm which is the base end.

The second arm may have a flat shape so as not to protrude towards the interior of the dispenser. The second arm may be movable translationally and/or rotationally with respect to the base of the body. The second arm extends in a direction from the side wall on which the first arm is attached towards a center of the base. In this context, extending towards the center of the base may mean that the general extension direction of the second arm is in a direction parallel to the base and substantially perpendicular to the side wall to which the first arm is attached. Further, in this context, center of the base may mean the center point of the base but may also mean the central area or region of the base around the center point of the base. The side wall end of the second arm is the end located closer to the side wall to which the first arm is attached than the other end of the second arm which is the locking end. In particular, the second arm may be disposed below the platform and above the base, i.e. between the platform and the base.

As discussed above, the side wall end of the second arm is configured to cooperate with the base end of the first arm.

However, the side wall end and the base end are not necessarily coupled to each other or connected to each other. In this case, a movement of the first arm causes a movement of the second arm by the base end of the first arm coming into contact with the side wall end of the second arm.

The locking portion arranged at the platform may have the shape of a hook, in particular, the shape of a half arrow constituting a snap hook design. In this case, the locking end of the second arm may be designed to be engageable with the snap hook, thereby interlocking with the locking portion of the platform. For example, the locking portion may approach and come into contact with the locking end of the second arm upon moving the platform downwards towards the base. Then, the snap hook design of the locking portion may interlock with the locking end of the second part. In order to release the interlocked state, the second arm may be moved such that the locking end of the second arm disengages from the locking portion of the platform.

The engaging portion at the lower surface of the lid is configured to engage with the top end of the first arm upon closing the lid to thereby release the platform from the locking position. For example, the engaging portion may protrude from the lower surface of the lid in order to engage with the top end of the first arm upon closing the lid. In another example, the engaging portion may be a lower wall portion of the lid. In this case, the top end of the first arm may protrude from the side wall, to which the first arm is attached, in an upwards direction. Then, upon closing the lid, the lower wall portion of the lid constituting the engaging portion may come into contact with the top end of the first arm, thereby causing a movement of the first arm. For example, the movement of the first arm may be a downward translational movement by pushing the engaging portion against the top end of the first arm. The movement of the first arm may then cause a movement of the second arm by cooperation of the side wall end of the second arm with the base end of the first arm. Then, the locking end of the second arm may disengage from the locking portion of the platform to thereby release the platform from the locking position. Hence, with this configuration, a releasable locking mechanism is established.

The dispenser as discussed herein may, as an example, have the following dimensions: the dispenser may have a height of 170 mm and a width of 200 mm and a depth of 141 mm. The height may include feet on which the dispenser may rest. It is to be understood that the dispenser may also have slightly smaller or larger dimensions than the above dimensions due to measurement tolerances.

The sheet material as discussed herein may be napkins. An individual sheet material may be an individual napkin. The individual napkin may, as an example, have the following nominal dimensions: when being folded in a stack of sheet material (stack of napkins), the individual napkin may have, in the folded state, a width of 165 mm and a length of 108 mm, or, alternatively, a width of 161 mm and a length of 105 mm. When being unfolded, in case of ½ fold, the individual napkin may have a width of 165 mm and a length of 216 mm, or, alternatively, a width of 161 mm and a length of 210 mm. Further, in case of ¼ fold, the individual napkin may have a width of 330 mm and a length of 216 mm. The above width dimensions of the individual napkin may vary between 3 to 5 mm. The above length dimensions of the individual napkin may have a smaller variation than the variation of the width dimension.

The locking portion may be arranged at a lower side of the platform.

The lower side of the platform may be the side opposing the side of the platform on which the stack of sheet material is disposed.

With this configuration, since the locking portion is arranged at the lower side of the platform, the locking mechanism does not interfere with the stack of sheet material.

The biasing means may be a spring disposed between a central region of the base and a central region of the platform and the locking portion of the platform may be located closer to the central region of the platform than to an edge portion of the platform, optionally, the locking portion may be located in the central region of the platform.

The spring may be a coil spring. As such, the spring may have a cylindrical outer shape or a frustoconical outer shape, wherein the diameter of the coil spring may be smaller at the end of the spring facing the base than the diameter of the coil spring at the end of the spring facing the platform.

The spring may be attached both to the base and the platform. For this purpose, both the base and the platform may be provided with attachment portions, such as hooks or the like.

The central region of the base and the central region of the platform may be understood as central portions of the respective parts, i.e. middle portions of the respective parts not comprising edge portions thereof. For example, the platform and the base may have a substantially rectangular shape. In this case, the central region of the platform and the base may be understood to be a certain area around the center point of the rectangular base and platform. In particular, in case the spring is a coil spring, the central region may be understood as a portion of the respective part, at which the coil spring is arranged. In this case, the central region may have an extension equal to the shape and the diameter of the coil spring.

Taking the example of the coil spring into account, the feature that the locking portion of the platform may be located closer to the central region of the platform than to an edge portion of the platform may mean that the locking portion of the platform is located closer to the coil spring than to an edge portion of the platform.

With this configuration, a locking connection between the locking end of the second arm and the locking portion of the platform is established close to the central region of the platform. With this configuration, since the locking connection between the locking end of the second arm and the locking portion of the platform is not established at an edge portion of the platform, the platform can be held in the locking position in a horizontal orientation. Hence, upon releasing the locking mechanism, the stack of sheet material is urged towards the dispensing opening in an upright orientation, thereby enabling easy withdrawal of individual sheet material.

In case the locking portion is located in the central region of the platform, the horizontal orientation of the platform is even more ensured. In this case, however, the second arm may need to be disposed below the spring in order not to interfere with the spring, thereby leading to a higher overall design of the dispenser.

The engaging portion may protrude from the lower surface of the lid, optionally, the engaging portion may have a length of 1/20 to 1/5, preferably 1/15 to 1/6, more preferably 1/12 to 1/8, most preferably 1/10 of the length of the first arm.

It may be advantageous when the top end of the first arm does not protrude from the side wall, for example, in order to prevent unintentional releasing of the locking mechanism when loading the dispenser with sheet material. In this case, providing the engaging portion protruding from the lower surface of the lid in order to engage with the top end of the first arm upon closing the lid allows the first arm to be designed so as not to protrude from the side wall to which the first arm is attached.

By providing the engaging portion with a length of 1/20 to 1/5, preferably 1/15 to 1/6, more preferably 1/12 to 1/8, most preferably 1/10 of the length of the first arm, the engaging portion can be provided with a short length. This has the advantage that, upon closing the lid, the short engaging portion only comes into contact with the top end of the first arm and thereby releases the locking mechanism, when the lid is in an almost closed position. Hence, the platform is urged upwards towards the dispensing opening only when the lid is in an almost closed position. Accordingly, with this configuration, the user is not subjected to any danger by the sudden movement of the platform as it may be the case when the locking mechanism is released with the lid in a half-open position. The narrower the above range, the better the above-mentioned advantages are achieved. If the engaging portion is too short, the locking mechanism may not be reliably released anymore.

The body may have a box shape with two long side walls and two short side walls respectively opposing each other, wherein the lid may be attached to one of the short side walls and the first arm may be provided on the other one of the short side walls.

For example, the base of the body may have a rectangular or substantially rectangular shape. In this case, the body may have a cuboid shape.

In case the lid is attached to one of the short side walls and the first arm is provided on the other one of the short side walls, the engaging portion of the lid may be arranged at a portion of the lid opposite to the portion where the lid is attached to the side wall.

With this configuration, since the lid opens and closes across the short side wall, the user can easily handle the stack of sheet material when loading the dispenser and push down the stack of sheet material into the dispenser without interfering with the lid. Moreover, some dispensers are provided with a double-walled side wall in which a space is provided for an advertising sheet or the like. Preferably, a long side wall is provided with the double-walled side wall in order to provide more space for the advertising sheet. By attaching the lid to one of the short side walls, the user can easily access the double-walled side wall of the long side wall for placing or removing an advertising sheet.

The first arm may be rotatably attached to the side wall about a first axis of rotation and the second arm may be rotatably attached to the base about a second axis of rotation.

For example, the first arm and the second arm may be rotatably attached by means of a pin or the like. In this case, the first and second axes of rotation may pass through the respective pin. In particular, the first axis of rotation and the second axis of rotation may be perpendicular to each other.

With this configuration, the first arm and the second arm perform a rotational instead of a translational movement. Therefore, compared to a translational movement, less space is required for the first arm and the second arm in their extension direction to perform the movement for releasing the locking mechanism.

At least one of the first and second arms may be rotatably attached with a spring-loaded mechanism, wherein the spring-loaded mechanism may be configured such that the at least one of the first and second arms rotates about the first or second axis of rotation, respectively, against a biasing force of the spring-loaded mechanism upon bringing the platform in the locking position and/or upon closing the lid.

The spring-loaded mechanism may be provided by means of a leg spring or a torsion spring or the like. Only one of the first arm and the second arm may be rotatably attached with the spring-loaded mechanism. However, also both of the first and second arms may be rotatably attached with the spring-loaded mechanism.

For example, in case the second arm is provided with a spring-loaded mechanism and in case the locking portion of the platform has a snap hook design, when the platform is pushed towards the base of the body, the snap hook of the locking portion coming into contact with the locking end of the second arm may cause the second arm to perform a rotational movement about the second axis of rotation against the biasing force of the spring-loaded mechanism of the second arm. Upon completion of the downward movement of the platform, i.e. when the platform is in the lowermost position, the second arm may perform a rotational movement in the opposite direction, urged by the spring-loaded mechanism in the second arm, thereby completing the snap hook locking. For releasing the snap hook locking, the lid is closed, whereby the engaging portion may engage with the top end of the first arm, whereby the first arm may perform a rotational movement which is transferred to the second arm via cooperation of the base end of the first arm with the side wall end of the second arm. At this time, the second arm undergoes a rotational movement against the biasing force of the spring-loaded mechanism, thereby disengaging from the snap hook of the locking portion of the platform. With this, the platform is released and urged in an upward direction towards the dispensing opening by the biasing means.

Since the base end of the first arm and the side wall end of the second arm are configured to cooperate with each other, only one spring-loaded mechanism, either in the first arm or in the second arm, may be necessary.

With this configuration, it is possible to provide an easy design of the releasable locking mechanism, wherein the components of the locking mechanism always return to their original position by means of the biasing force of the spring-loaded mechanism, thereby enabling repeated locking and releasing of the locking mechanism.

The engaging portion may have a slanted surface matching with a corresponding slanted surface provided on the top end of the first arm.

For example, the slanted surface may be angled with respect to the base of the body, having an angle of about 45°. In particular, the surface normal of the slanted surface of the engaging portion may point in an opposite direction as the surface normal of the corresponding slanted surface provided on the top end of the first end.

With this configuration, when the lid is closed and the engaging portion engages with the top end of the first arm, due to the provision of slanted surfaces, the engaging portion makes the first arm performing a rotational movement. Hence, it is possible to provide an easy means for urging the first arm and, consequently, the second arm in a rotational movement.

The dispenser may have a spring-loaded latch for releasably locking the lid to the body.

The spring-loaded mechanism for the spring-loaded latch may be constituted by a leg spring or a torsion spring or the like. The spring-loaded latch may be provided on the lid or on one of the side walls of the body.

With this configuration, it is possible to provide an easy mechanism of keeping the dispenser in a closed state.

The first arm may be arranged along a central axis of the one of the side walls, the central axis of the one of the side walls extending in a direction from the top to the base and dividing the one of the side walls into two halves, and the second arm may be arranged along a central axis of the base, the central axis of the base extending in a direction from the side wall at which the first arm is arranged towards the opposite side wall and dividing the base into two halves.

For example, in case the body has a box shape or a cuboid shape, the central axis of the one of the side walls and the central axis of the base may correspond to the perpendicular bisector of the one of the side walls and, respectively, of the base.

It is to be understood, that this configuration not only means that the central axis divides the one of the side walls or the base into two perfectly equal haves, but may also mean that the first arm and the second arm are arranged along the respective central axis not dividing the respective parts into two perfectly equal haves, but into nearly equal halves.

With this configuration, it is possible to provide the locking mechanism with the smallest possible length of the first arm and the second arm, thereby saving material costs. Moreover, it is possible to arrange the locking mechanism such that the locking connection between the locking end of the second arm and the locking portion of the platform is located at a central position with respect to platform. Hence, upon releasing the locking mechanism, the platform and the stack of sheet material is urged upwards towards the dispensing opening in a horizontal and upright orientation.

The dispenser may comprise a first pair of the first arms, a second pair of the second arms, a pair of the engaging portions, and a pair of the locking portions.

In this configuration, each of the first arms of the first pair may be the same or may have the same configuration as the first arm described above. Likewise, each of the second arms of the second pair may be the same or may have the same configuration as the second arm described above.

Likewise, each of the pair of engaging portions may be the same or may have the same configuration as the engaging portion described above. Likewise, each of the pair of locking portions may be the same or may have the same configuration as the locking portion described above.

In particular, the first arms of the first pair may have a mirror symmetric configuration, the second arms of the second pair may have a mirror symmetric configuration, the engaging portions may have a mirror symmetric configuration, and the locking portions may have a mirror symmetric configuration.

For example, one of the engaging portions may cooperate with one of the first arms, the one of the first arms may cooperate with one of the second arms, and the one of the second arms may cooperate with one of the locking portions. Likewise, the other one of the engaging portions may cooperate with the other one of the first arms, the other one of the first arms may cooperate with the other one of the second arms, and the other one of the second arms may cooperate with the other one of the locking portions.

With this configuration, although leading to a more complex design of the dispenser, by providing not only one of the above components but a pair of the above components, the platform of the dispenser can be even more reliably held in the locking position in a horizontal orientation, thereby enabling a more reliable urging of the platform and the stack of sheet material towards the dispensing opening in an upright orientation and, thus, easy withdrawal of individual sheet material.

Having such an arrangement is not obviously derivable by the person skilled in the art, as providing a pair of these components, at first sight, provokes a more complex system and requires a more precise coordination of the involved components.

The locking portions of the platform may be symmetrically arranged with respect to a longitudinal axis or a transversal axis of the platform, wherein the first pair of the first arms may be symmetrically arranged with respect to a central axis of the one of the side walls, the central axis of the one of the side walls extending in a direction from the top to the base and dividing the one of the side walls into two halves, wherein the second pair of the second arms may be symmetrically arranged with respect to a central axis of the base, the central axis of the base extending in a direction from the side wall at which the first pair of the first arms is arranged towards the opposite side wall and dividing the base into two halves.

In case of a rectangular shape of the platform, the longitudinal axis may be the long axis of the platform and the transversal axis may be the short axis of the platform. In case of a square shape of the platform, one of the perpendicular bisectors of the square-shaped platform may be the longitudinal axis and the other one of the perpendicular bisectors of the square-shaped platform may be the transversal axis. Both the longitudinal axis and the transversal axis may divide the platform into two halves, as is the case for the central axis.

The "central axis" may be as described above.

"Symmetrically arranged" with respect to the respective axis may mean that the respective parts have the same distance to the axis. It does, however, not necessarily imply that the respective parts need to be mirror symmetric.

In particular, however, the locking portions of the platform may be mirror symmetric with respect to longitudinal axis or the transversal axis of the platform, the first pair of the first arms may be mirror symmetric with respect to the central axis of the one of the side walls, and the second pair of the second arms may be mirror symmetric with respect to the central axis of the base.

For example, in case the body has a box shape with two long side walls and two short side walls respectively opposing each other, the first pair of the first arms may be arranged at one of the short side walls or may be arranged at one of long side walls.

With this configuration, due to the fact that the components constituting the locking mechanism are arranged symmetrically with respect to the respective axes, the platform of the dispenser can be particularly reliably held in the locking position in a horizontal orientation, thereby enabling a particularly reliable urging of the platform and the stack of sheet material towards the dispensing opening in an upright orientation and, thus, easy withdrawal of individual sheet material.

Having such an arrangement is not obviously derivable by the person skilled in the art, as arranging the respective components constituting the locking mechanism symmetrically with respect to the respective axes, at first sight, provokes a more precise alignment and construction of the involved components.

Further aspects of the present disclosure may be found in the following description of a particular embodiment referring to the accompanying drawings.

DETAILED DESCRIPTION OF A PARTICULAR EMBODIMENT

Figure 1:
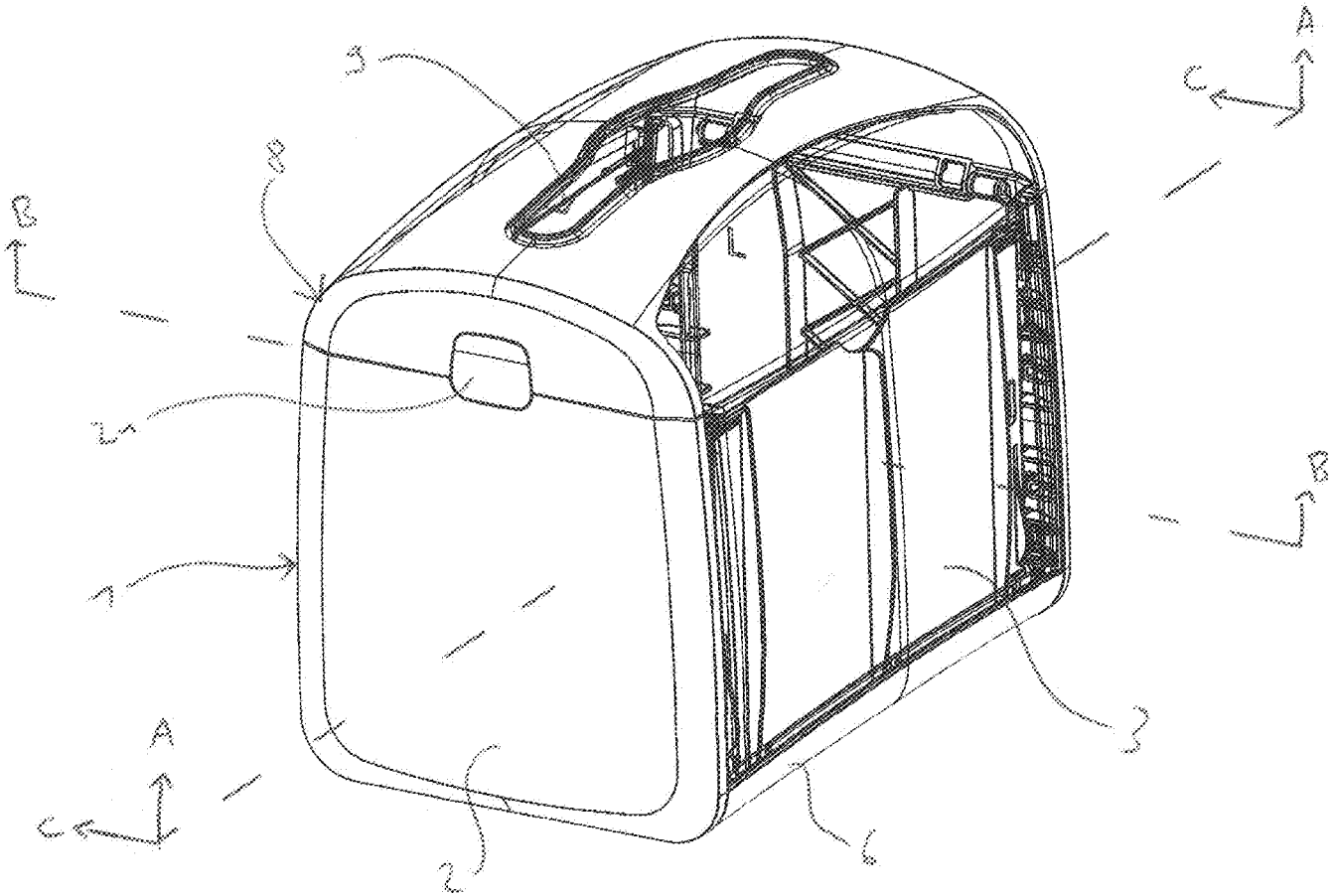
FIG. 1 is a perspective view of a tabletop dispenser.

Hereinafter, an embodiment according to the disclosure will be described in detail with reference to the accompanying drawings in order to describe the disclosure using illustrative examples. Further modifications of certain individual features described in this context can be combined with other features of the described embodiments to form further embodiments of the disclosure.

Throughout the drawings, the same reference numerals are used for similar elements.

FIG. 1 is a perspective view of a tabletop dispenser. The tabletop dispenser comprises a body 1 having four side walls 2, 3, 4, and 5 (the side wall 4 is the side wall opposite to the side wall 2, and the sidewall 5 is a side wall opposite to the side wall 3). The tabletop dispenser further has a base 6 and a lid 8. The tabletop dispenser of this embodiment has a box shape with the two short side walls 2, 3 and the two long side walls 3, 5. In this embodiment, the lid 8 is movably attached to the short side wall 4. The lid 8 is provided with a dispensing opening 9 having a slot shape, wherein the two sections to the side are slot shaped and the central portion of the opening has an oval shape. Moreover, the tabletop dispenser comprises a spring-loaded latch 21.

In an alternative (non-illustrated) embodiment, the lid 8 may be configured to be reversibly removable and attachable to the body 1 of the dispenser. In such a configuration, the lid 8 can be put aside for (re-)filling the dispenser (open refilling position) and put back onto the body 1 in order to arrive at the closed use position thereof.

Figure 2:
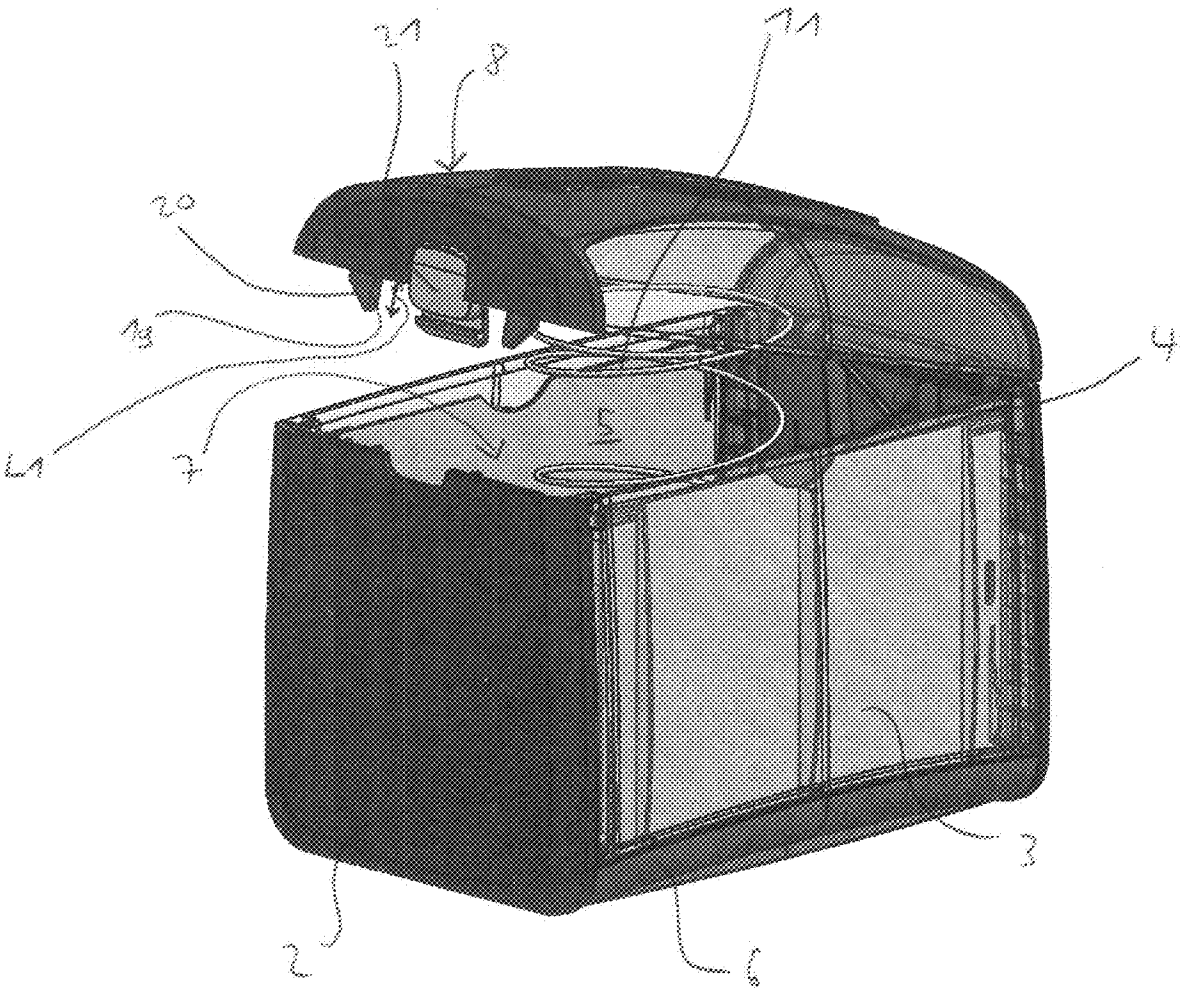
FIG. 2 is a perspective view of the tabletop dispenser of FIG. 1 with an open lid, wherein a platform is omitted.

FIG. 2 is a perspective view of the tabletop dispenser of FIG. 1 with an open lid 8, wherein a platform 10 is omitted. The lid 8 is movably attached to the short side wall 4 by means of hinges, such that the lid 8 can be opened across the short side wall 4. When the lid 8 is completely opened, the opening 7 in a top of the body is easily accessible. In this embodiment, a coil spring is provided as a biasing means 11. The coil spring shown in FIG. 2 is in a relaxed state. Furthermore, the lid 8 has a pair of engaging portions 19 provided at its lower surface. Each of the engaging portions 19 has a slanted surface 20.

Figure 3:
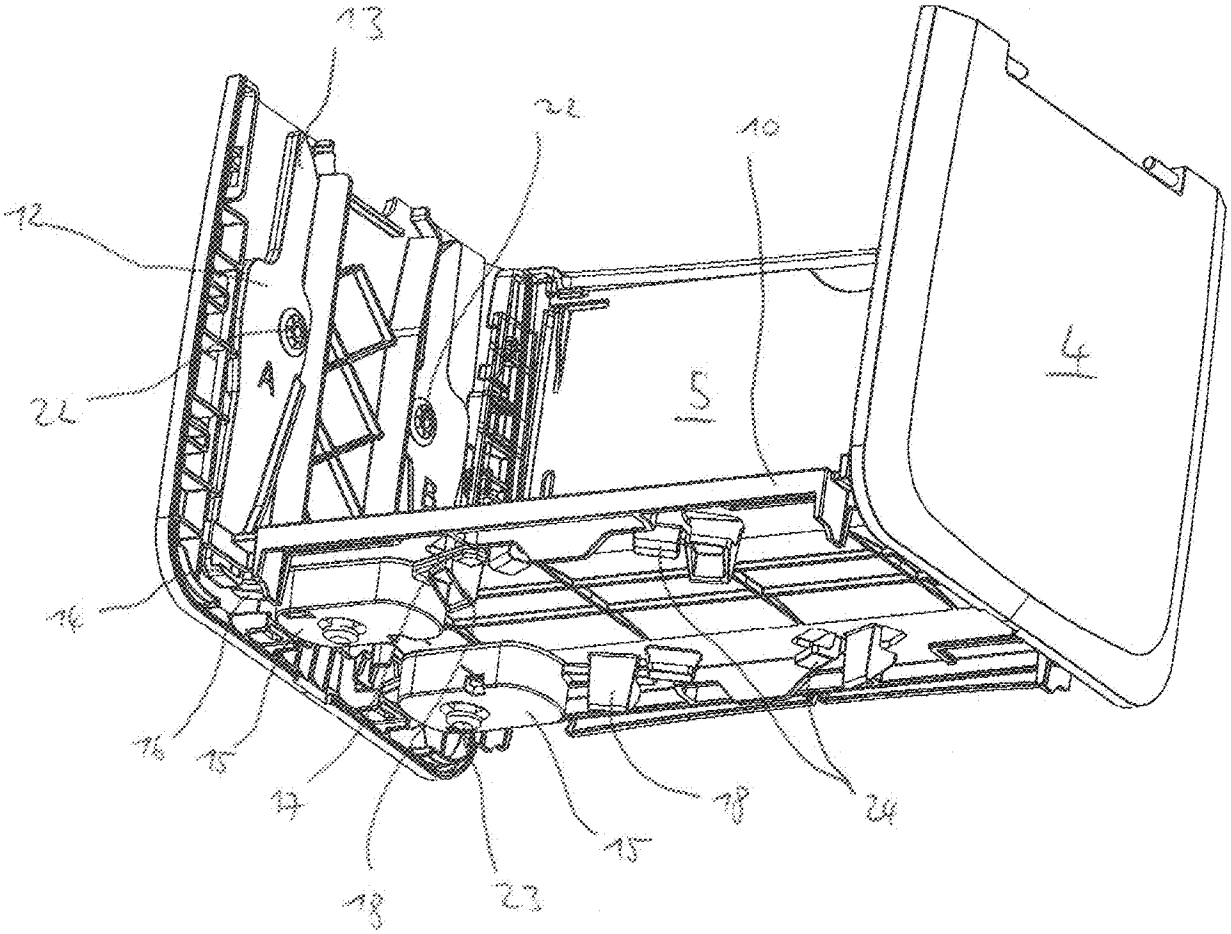
FIG. 3 is a perspective view of the tabletop dispenser of FIG. 1 wherein a base, a side wall, a biasing means, and a lid are omitted.

FIG. 3 is a perspective view of the tabletop dispenser of FIG. 1 wherein the base 6, the side wall 3, the lid 8, and the biasing means 11 are omitted. A first pair of first arms 12 is attached to the side wall 2 (the side wall 2 is opposite to the side wall 4). In this embodiment, the first pair of the first arms 12 is rotatably attached to the side wall 2 by means of a pair of pins 22. Moreover, as can be seen, the first arms 12 are mirror symmetric with respect to a central axis C of the side wall 2, wherein the central axis C extends in a direction from the base 6 of the body 1 towards the top of the body 1 and divides the side wall 2 into two halves (shown in more detail in FIG. 5). Likewise, the second pair of the second arms 15 is attached to the base 6 (the base 6 is not shown in FIG. 3). The second pair of second arms 15 is rotatably attached to the base 6 by means of pins 23. Moreover, as can be seen, the second arms 15 are mirror symmetric with respect to a central axis D of the base 6, wherein the central axis D extends in a direction from the side wall 2 towards the side wall 4 and divides the base 6 into two halves (shown in more detail in FIG. 6). In this embodiment, the second arms 15 are also mirror symmetric with respect to a longitudinal axis of the platform 10.

Each of the first arms 12 has a top end 13 and a base end 14. The top end 13 is provided with a slanted surface matching with the slanted surface 20 of the engaging portion 19. The base end 14 is configured to cooperate with the side wall end 16 of the second arm 15. Each of the second arms 15 has the side wall end 16 configured to cooperate with the base and 14 of the first arm 12 and has a locking end 17 configured to releasably interlock with a locking portion 18 arranged at the platform 10, thereby holding the platform 10 in the locking position, as seen in FIG. 3. In this embodiment, the locking portion 18 has a snap hook design. Further, in this embodiment, each of the second pair of the second arms 15 comprises a spring-loaded mechanism.

Moreover, as can be seen in FIG. 3, hooks 24 are provided on the lower side of the platform 10 for attachment of the biasing means 11 which, in the present embodiment, is a coil spring, as described above. In this case, the central region of the platform 10 corresponds to the region where the upper end of the coil spring is attached to the platform 10. Since the locking portions 18 are located closer to the central region of the platform 10 than to an edge portion of the platform 10 and are symmetrically arranged with respect to the longitudinal axis of the platform 10, the platform 10 can be held in the locking position in a horizontal orientation, thereby achieving the above-described advantages. Specifically, upon releasing the locking mechanism, the platform 10 and the stack of sheet material placed thereon is urged towards the dispensing opening 9 in an upright orientation which enables easy grasping of individual sheet material.

Figure 4:
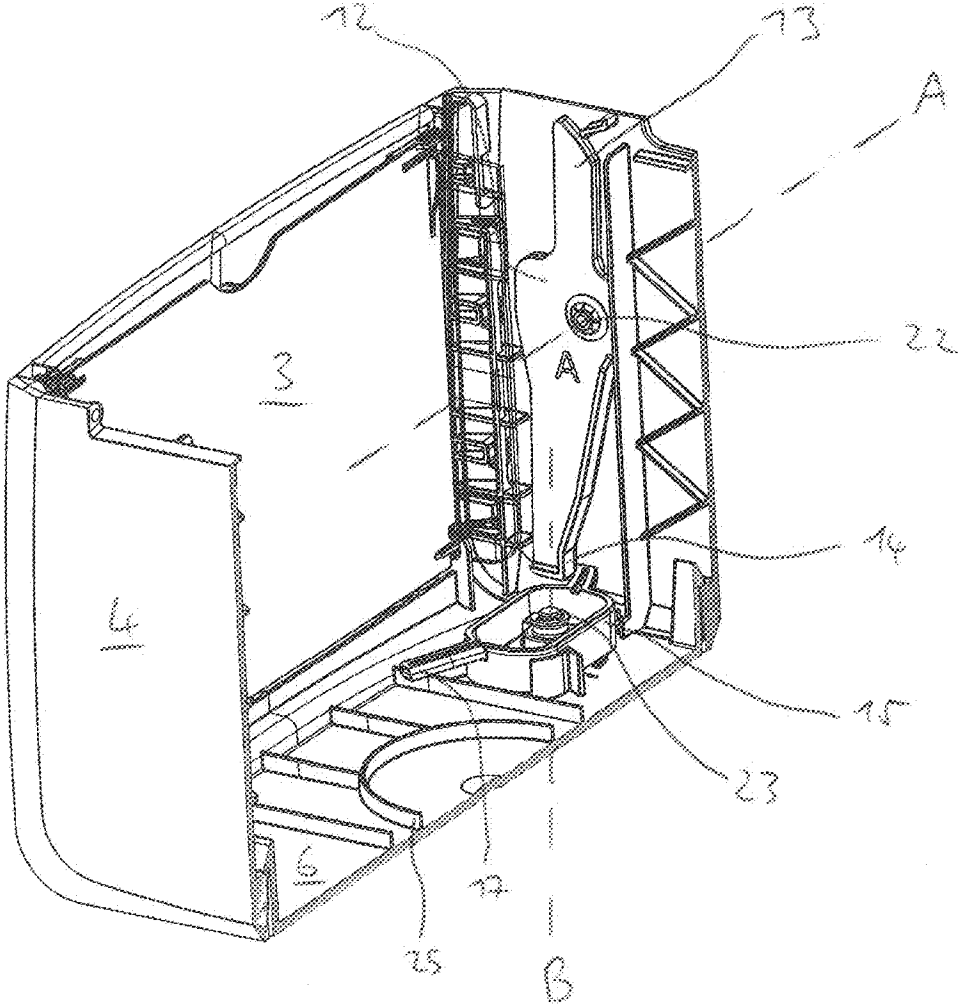
FIG. 4 is a perspective sectional view along the line A-A in FIG. 1, wherein a lid, a platform, and a biasing means are omitted.

FIGS. 3 and 4 also illustrates the releasable locking mechanism according to the present disclosure. In FIG. 3, the platform 10 is in the locking position in the lowermost position. In order to release the locking mechanism, the lid 8 is brought into the closed position, whereby the slanted surface 20 of the engaging portion 19 is brought into contact with the slanted surface provided at the top end 13 of the first arm 12. As a result, each of the first arms 12 rotates about a first axis of rotation A (shown in FIG. 4) passing through the pins 22. In this embodiment, specifically, as seen in a direction towards the first arms 12, the left first arm 12 rotates counterclockwise, whereas the right first arm 12 rotates clockwise. At the same time, since the base end 14 of the first arm 12 is configured to cooperate with the side wall end 16 of the second arm 15, each of the second arms 15 is also subjected to a rotational movement about a second axis of rotation B (shown in FIG. 4) passing through the pins 23. In this embodiment, specifically, as seen from below, the left second arm 15 cooperating with the left first arm 12 rotates counterclockwise, whereas the right second arm 15 cooperating with the right first arm 12 rotates clockwise. With this movement, the locking end 17 of each of the second arms 15 disengages from each of the locking portions 18, thereby releasing the locking mechanism.

FIG. 4 is a perspective sectional view along the line A-A in FIG. 1, wherein the lid 8, the platform 10, and the biasing means 11 are omitted. As can be seen in FIG. 4, the first arm 12 is rotatably attached at the sidewall 2 about the first axis of rotation A. The second arm 15 is rotatably attached at the base 6 about the second axis of rotation B. In this embodiment, the first axis of rotation A is perpendicular to the second axis of rotation B. Moreover, the base 6 has a circular wall portion 25 which is provided for holding the biasing means 11 in form of a coil spring in place. Thus, considering the above explanations with respect to the central region, this portion of the base 6 may be considered as central region of the base 6.

Figure 5:
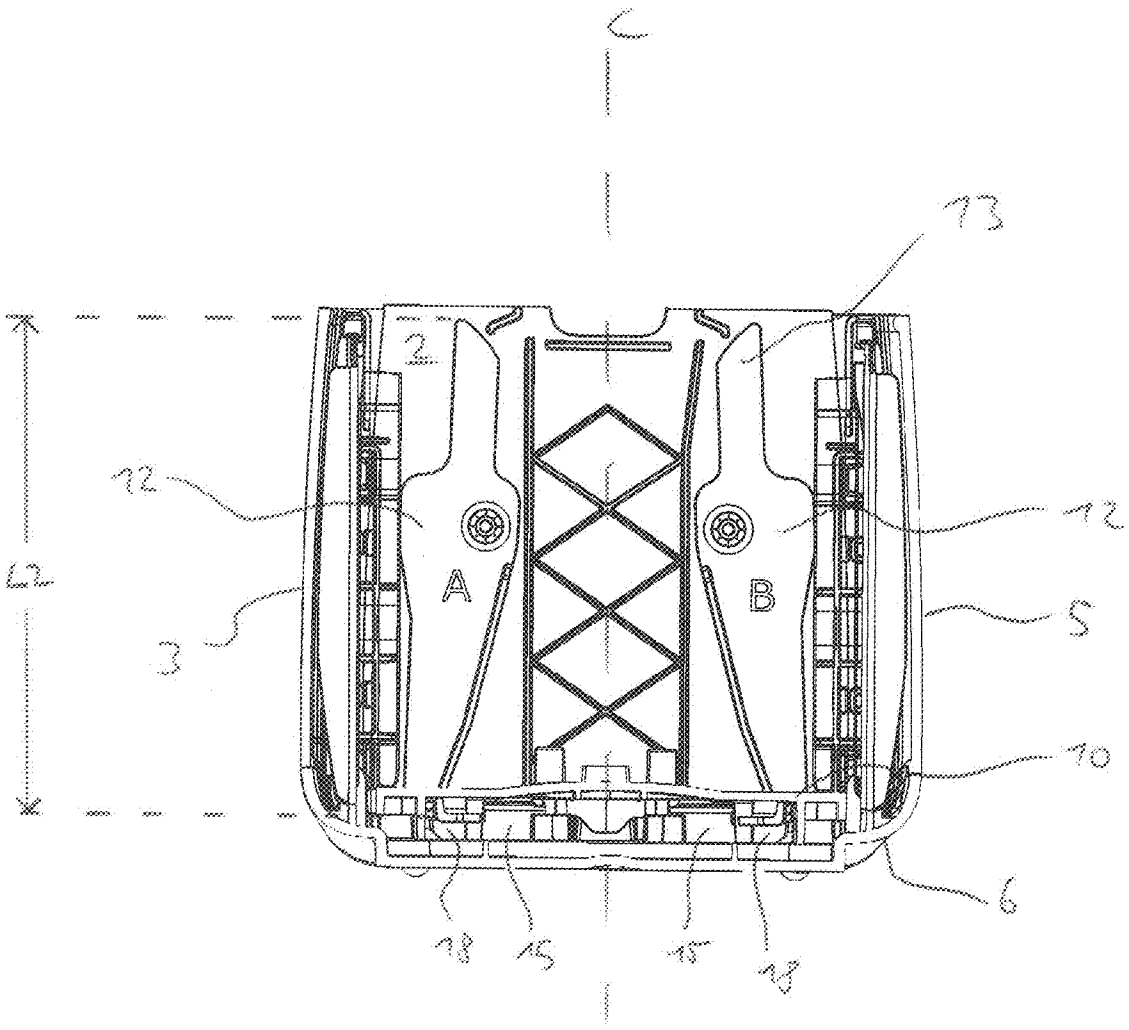
FIG. 5 is a sectional view along the line B-B in FIG. 1, wherein a lid and a biasing means are omitted.

FIG. 5 is a sectional view along the line B-B in FIG. 1, wherein the lid 8 and the biasing means 11 are omitted. As can be seen in FIG. 5, the locking portion 18 is arranged at a lower side of the platform 10. Furthermore, each of the second pair of the second arms 15 is disposed below the platform 10, thereby not interfering with the stack of sheet material.

Figure 6:
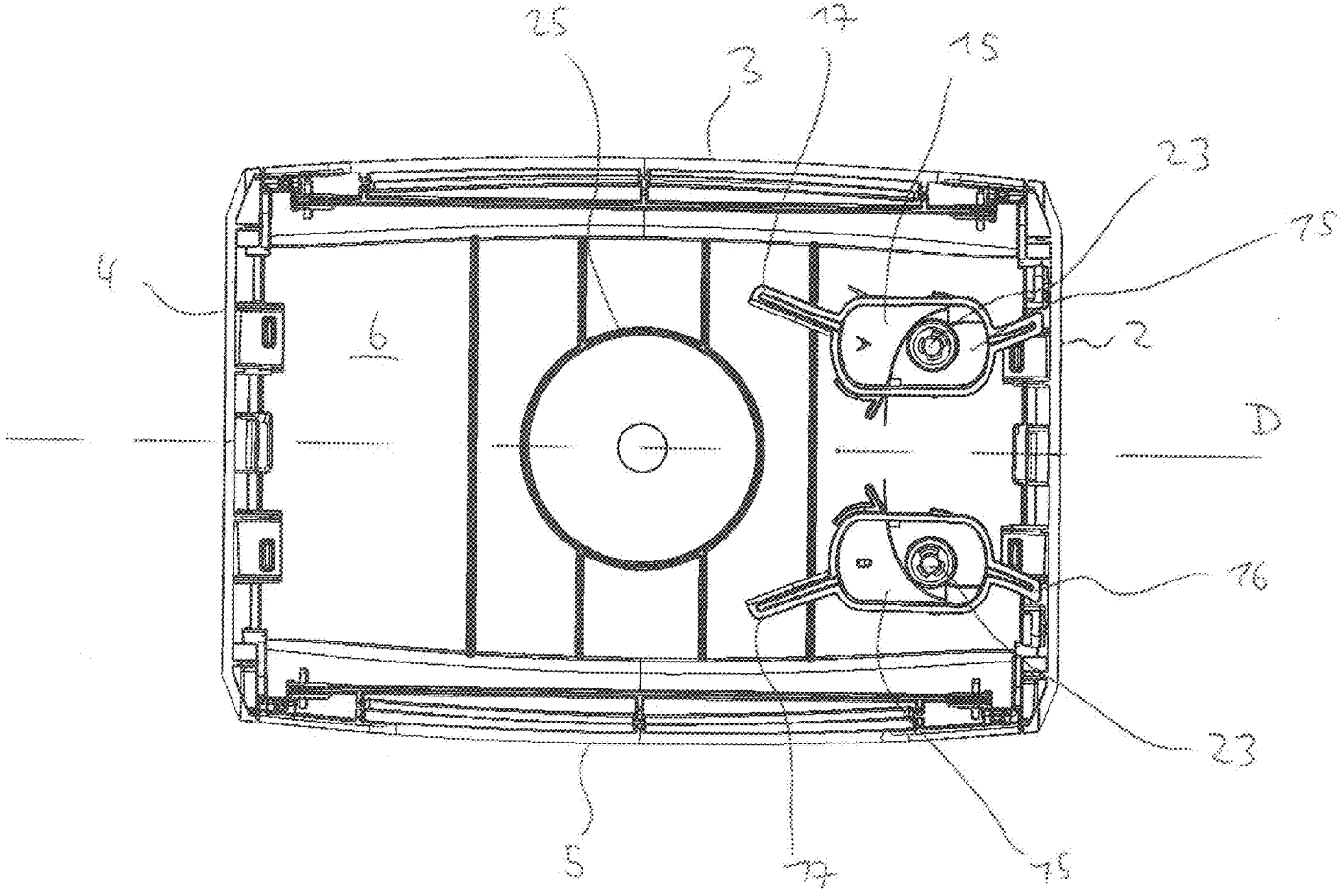
FIG. 6 is a sectional view along the line C-C in FIG. 1, wherein a platform and a biasing means are omitted.

FIG. 6 is a sectional view along the line C-C in FIG. 1, wherein the platform 10 and the biasing means 11 are omitted. FIG. 6 illustrates the mirror symmetric configuration of the second pair of the second arms 15 with respect to the central axis D of the base 6. Due to the second arms 15 being arranged symmetrically with respect to the central axis D, the platform 10 of the dispenser can be particularly reliably held in the locking position in a horizontal orientation, thereby enabling a more reliable urging of the platform 10 and the stack of sheet material towards the dispensing opening 9 in an upright orientation and, thus, easy withdrawal of individual sheet material.

As a first step to load a stack of sheet material, which is now be described in the exemplary form of napkins, into the dispenser, the above-described lid 8 is moved from the above-mentioned closed use position into the open refilling position.

Then, the stack of napkins is placed with a bottom face (trailing face) of the stack of napkins on the platform 10 of the dispenser via the opening 7 of the dispenser, wherein said platform 10 is reciprocally movable within the body 1 of the dispenser, as described above.

Subsequently, a force is exerted on a top face (leading face) of the stack of sheet material opposite to the bottom face (trailing face) to thereby push the platform 10 into the body 1 of the dispenser.

Before or after exerting the force on the top face of the stack of the sheet material and before or after placing the stack of napkins with the bottom face of the stack of napkins on the support surface, it may be particularly useful to at least partially fold the leading napkin at at least one of its edges. As a result, a so-called starter fold is formed.

The starter fold enables to easily grasp the leading napkin when the dispenser is freshly refilled.

On top of that, the napkins are usually distributed in bundles (stacks of sheet material) comprising a predetermined number of sheet material (e.g. napkins). In many cases more than one bundle (stack of sheet material) is inserted into the dispenser during refilling. Whereas the sheet material is usually interfolded within one bundle (stack of sheet material), the trailing sheet material of a first bundle (first stack of sheet material) and the leading sheet material of a second bundle (second stack of sheet material) are not interfolded. As a result, once the trailing sheet material of the first bundle is dispensed during use, the leading sheet material of the second bundle is not automatically withdrawn through the dispensing opening in part for being easily graspable. As a result, it is beneficial to also fold the leading sheet of any bundle (stack of sheet material) inserted into the dispenser in the same manner as described above forming a starter fold.

Even though there is no interfolding at a "stack-break" (also called bundle break), i.e. the transition from one stack of sheet material to another one, a consistent and reliable use of the dispenser can be ensured by at least partially folding the leading napkin of each bundle at at least one of its edges, and the user is never confronted with any napkin that is hard to grasp.

Afterwards, the lid 8 is pivoted from the open refilling position into the closed use position again, such that the lid 8 is closed.

Finally, a portion of a leading sheet material, i.e. a (partially folded) leading napkin is extracted from the top face of the stack of napkins through the dispensing opening 9 of the lid 8 to thereby dispose that leading napkin.

Accordingly, the stack of napkins can be successfully and easily loaded into the dispenser, and the dispenser is thereby filled with napkins.

The invention claimed is:

1. A dispenser for dispensing sheet material, comprising:
a body having four side walls,
a base,
an opening in a top of the body,
a lid for covering the opening in use and enabling access to the opening for refilling, wherein the lid has a dispensing opening therein to enable sheet material to be dispensed therefrom,
a platform for supporting a plurality of sheet material from below, wherein the platform is movable from a lowermost position when the dispenser is filled with sheet material to an uppermost position adjacent the lid when the dispenser is more nearly empty of sheet material,
a biasing structure configured to urge the platform towards the lid, and
a releasable locking mechanism for holding the platform in a locking position in the lowermost position, the releasable locking mechanism comprising:
a first arm movably attached to and in contact with one of the side walls and extending in a direction from the top towards the base of the body, wherein the first arm has a top end and a base end,
a second arm movably attached to the base and extending in a direction from the side wall to which the first arm is attached towards a center of the base,
wherein the second arm has a side wall end and a locking end, the side wall end being configured to cooperate with the base end of the first arm such that a movement of the first arm causes a movement of the second arm, the locking end being configured to releasably interlock with a locking portion arranged at the platform to thereby hold the platform in the locking position, and
wherein the lid has an engaging portion at a lower surface thereof configured to engage with the top end of the first arm upon closing the lid to thereby release the platform from the locking position.

2. The dispenser according to claim 1,
wherein the locking portion is arranged at a lower side of the platform.

3. The dispenser according to claim 1,
wherein the engaging portion protrudes from the lower surface of the lid.

4. The dispenser according to claim 1,
wherein the body has a box shape with two long side walls and two short side walls respectively opposing each other, wherein the lid is attached to one of the short side walls and the first arm is provided on the other one of the short side walls.

5. The dispenser according to claim 1,
wherein the first arm is rotatably attached to the side wall about a first axis of rotation (A) and the second arm is rotatably attached to the base about a second axis of rotation (B).

6. The dispenser according to claim 5,
wherein at least one of the first and second arms is rotatably attached with a spring-loaded mechanism,
wherein the spring-loaded mechanism is configured such that the at least one of the first and second arms rotates about the first or second axis of rotation (A, B), respectively, against a biasing force of the spring-loaded mechanism upon bringing the platform in the locking position and/or upon closing the lid.

7. The dispenser according to claim 5,
wherein the engaging portion has a slanted surface matching with a corresponding slanted surface provided on the top end of the first arm.

8. The dispenser according to claim 1, wherein the dispenser has a spring-loaded latch for releasably locking the lid to the body.

9. The dispenser according to claim 1, comprising:

a first pair of the first arms, a second pair of the second arms, a pair of the engaging portions, a pair of the locking portions.

10. The dispenser according to claim 9, wherein the locking portions of the platform are symmetrically arranged with respect to a longitudinal axis or a transversal axis of the platform, wherein the first pair of the first arms is symmetrically arranged with respect to a central axis (C) of the one of the side walls, the central axis (C) of the one of the side walls extending in a direction from the top to the base and dividing the one of the side walls into two halves, wherein the second pair of the second arms is symmetrically arranged with respect to a central axis (D) of the base, the central axis (D) of the base extending in a direction from the side wall at which the first pair of the first arms is arranged towards the opposite side wall and dividing the base into two halves.

11. The dispenser according to claim 1, wherein the lid is moveably attached to at least one of the side walls of the body via a hinge.

12. The dispenser according to claim 1, wherein the lid is configured to be reversibly removable and attachable to the body.

13. The dispenser according to claim 3, wherein the engaging portion has a length (L1) of 1/20 to 1/5 of the length (L2) of the first arm.

14. The dispenser according to claim 3, wherein the engaging portion has a length (L1) of 1/15 to 1/6 of the length (L2) of the first arm.

15. The dispenser according to claim 3, wherein the engaging portion has a length (L1) of 1/12 to 1/8 of the length (L2) of the first arm.

16. The dispenser according to claim 3, wherein the engaging portion has a length (L1) of 1/10 of the length (L2) of the first arm.

17. The dispenser according to claim 1, wherein an entirety of the second arm is disposed below the platform in the lowermost position.

18. A dispenser for dispensing sheet material, comprising:

a body having four side walls, a base, an opening in a top of the body, a lid for covering the opening in use and enabling access to the opening for refilling, wherein the lid has a dispensing opening therein to enable sheet material to be dispensed therefrom, a platform for supporting a plurality of sheet material from below, wherein the platform is movable from a lowermost position when the dispenser is filled with sheet material to an uppermost position adjacent the lid when the dispenser is more nearly empty of sheet material, a spring configured to urge the platform towards the lid, and a releasable locking mechanism for holding the platform in a locking position in the lowermost position, the releasable locking mechanism comprising:

a first arm movably attached to one of the side walls and extending in a direction from the top towards the base of the body, wherein the first arm has a top end and a base end, a second arm movably attached to the base and extending in a direction from the side wall to which the first arm is attached towards a center of the base, wherein the second arm has a side wall end and a locking end, the side wall end being configured to cooperate with the base end of the first arm such that a movement of the first arm causes a movement of the second arm, the locking end being configured to releasably interlock with a locking portion arranged at the platform to thereby hold the platform in the locking position, wherein the lid has an engaging portion at a lower surface thereof configured to engage with the top end of the first arm upon closing the lid to thereby release the platform from the locking position, wherein the spring is attached between a central region of the base and a central region of the platform, and wherein the locking portion of the platform is located closer to the central region of the platform than to an edge portion of the platform.

19. The dispenser according to claim 18, wherein the locking portion is located in the central region of the platform.

20. A dispenser for dispensing sheet material, comprising:

a body having four side walls, a base, an opening in a top of the body, a lid for covering the opening in use and enabling access to the opening for refilling, wherein the lid has a dispensing opening therein to enable sheet material to be dispensed therefrom, a platform for supporting a plurality of sheet material from below, wherein the platform is movable from a lowermost position when the dispenser is filled with sheet material to an uppermost position adjacent the lid when the dispenser is more nearly empty of sheet material, a biasing structure configured to urge the platform towards the lid, and a releasable locking mechanism for holding the platform in a locking position in the lowermost position, the releasable locking mechanism comprising:

a first arm movably attached to one of the side walls and extending in a direction from the top towards the base of the body, wherein the first arm has a top end and a base end, a second arm movably attached to the base and extending in a direction from the side wall to which the first arm is attached towards a center of the base, wherein the second arm has a side wall end and a locking end, the side wall end being configured to cooperate with the base end of the first arm such that a movement of the first arm causes a movement of the second arm, the locking end being configured to releasably interlock with a locking portion arranged at the platform to thereby hold the platform in the locking position, wherein the lid has an engaging portion at a lower surface thereof configured to engage with the top end of the first arm upon closing the lid to thereby release the platform from the locking position, wherein the first arm is arranged along a central axis (C) of the one of the side walls, the central axis (C) of the one of the side walls extending in a direction from the top to the base and dividing the one of the side walls into two halves, wherein the second arm is arranged along a central axis (D) of the base, the central axis (D) of the base extending in a direction from the side wall at which the first arm is arranged towards the opposite side wall and dividing the base into two halves.

* * * * *